US005135404A

United States Patent [19]

Clark et al.

[11] Patent Number: 5,135,404

[45] Date of Patent: Aug. 4, 1992

[54] INSULATING LINER FOR AN ELECTRICAL PLUG ASSEMBLY

[75] Inventors: William E. Clark, Syracuse, N.Y.

[73] Assignee: Cooper Industries, Inc., Houston, Tex.

[21] Appl. No.: 761,542

[22] Filed: Sep. 18, 1991

[51] Int. Cl.[5] ..... H01R 13/502

[52] U.S. Cl. ..... 439/106; 439/469; 439/695

[58] Field of Search ..... 439/97, 106, 460, 462, 439/469, 692, 695

[56] References Cited

FOREIGN PATENT DOCUMENTS 2075278 11/1981 United Kingdom ..... 439/460

*Primary Examiner*—Eugene F. Desmond

*Attorney, Agent, or Firm*—Eddie Scott; W. Bruce Patterson; Alan R. Thiele

[57] ABSTRACT

An insulating liner for an electrical plug which fits between the plug body and the plug assembly when conductors are located. The liner rotates within the plug body and is retained in the plug body by a tab and groove.

7 Claims, 3 Drawing Sheets

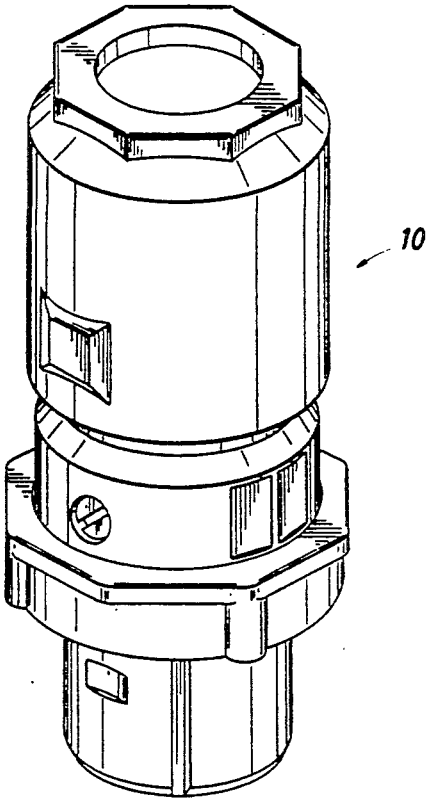
FIG. 1
FIG. 4
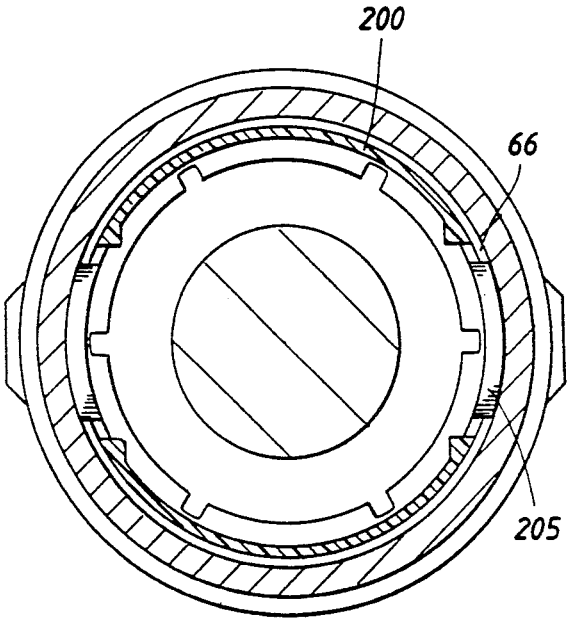
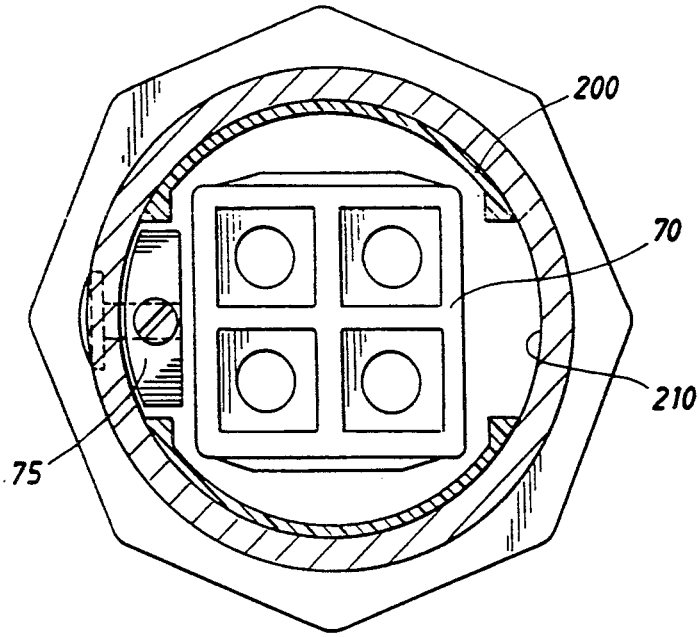
FIG. 5

20
10
55
60
40
200
4
66
65
4
35
5
75
70
5
71
35
21
50
30

INSULATING LINER FOR AN ELECTRICAL PLUG ASSEMBLY

BACKGROUND OF THE INVENTION

The present invention relates to electrical plugs in the 30, 60 and 100 amp range; more particularly, the invention relates to an insulating liner which is housed in a plug body and prevents electrical contact between electrical conductors and the plug body.

Heavy duty electrical plugs are used to connect high current, portable electrical equipment to electrical receptacles. The plugs provide for termination of an electrical cord into a number of prongs which are mated to the receptacle. The plug assemblies usually consist of a body, a cover secured to one end of the body where the electrical cord enters and a plug sleeve attached to the opposite end of the body where the prongs are located.

The plugs are designed with adjustable cord gripping and sealing means to allow connection of the plugs to cords of varying diameters. Such a plug design is disclosed in U.S. patent application Ser. No. 725,170 filed Jul. 3, 1991 and the contents of that application are incorporated herein by reference. The plugs are also intended for installation and removal by field personnel without the need for special tools.

Preparation of an electrical cord for attachment to the plug body requires the individual conductors to be exposed and then inserted into the prong assembly where they are held by contact screws. Because each conductor is made up of many strands, some strands can remain exposed creating a risk of short circuit if they come into contact with the outer shell or body of the plug assembly. In addition, heavy duty plugs of the type discussed here are used under harsh conditions and are subject to pulling forces which can cause one of all of the conductors to be pulled out of the prong assembly, also creating the risk of short circuit and injury to personnel.

One way to insulate the area between the conductors and the plug body is to cover the interior of the plug body with an insulating material. However, to properly ground the plug assembly, all metal parts must be in contact in at least one place. Any interference of the insulating material with the proper grounding of the parts could, itself cause a hazard to personnel. In addition, most multi-piece plug assemblies are threaded together requiring the threaded surfaces to be exposed.

There is a need therefore, for an insulator which can be installed between the prong assembly and plug body to prevent electrical contact between conductors and metallic parts of the plug body.

There is a further need therefore, for a plug body insulator which is retained in the plug body making assembly of the plug easy and preventing the loss of the insulator.

There is yet a further need therefore, for an insulator which will rotate inside the plug body as the parts of the plug are assembled and not interfere with electrical grounding connections between different parts of the plug assembly. cl SUMMARY OF THE INVENTION The insulating liner of the present invention prevents electrical contact between the conductors of an electrical cord and other metallic parts of a heavy duty electrical plug. The liner is cylindrically shaped and fits between the plug body and the prong assembly where the conductors are terminated. To prevent loss or misuse, the liner is retained in the plug body by means of a groove on the inside wall of the plug body. Additionally, the liner rotates within the plug body as the plug is assembled insuring that the grounding post remains electrically connected to the plug body when the plug is assembled.

BRIEF DESCRIPTION OF THE FIGURES

A better understanding of the present invention may be had by reference to the drawings wherein:

FIG. 1 is a perspective view showing an electrical plug assembly in which the present invention is used;

FIG. 4 is a sectional view of the insulating liner shown in an electrical plug body along a line 4;

FIG. 5 is a sectional view of the insulating liner shown in an electrical plug body along a line 5.

DETAILED DESCRIPTION OF A PREFERRED EMBODIMENT

Figure 2:
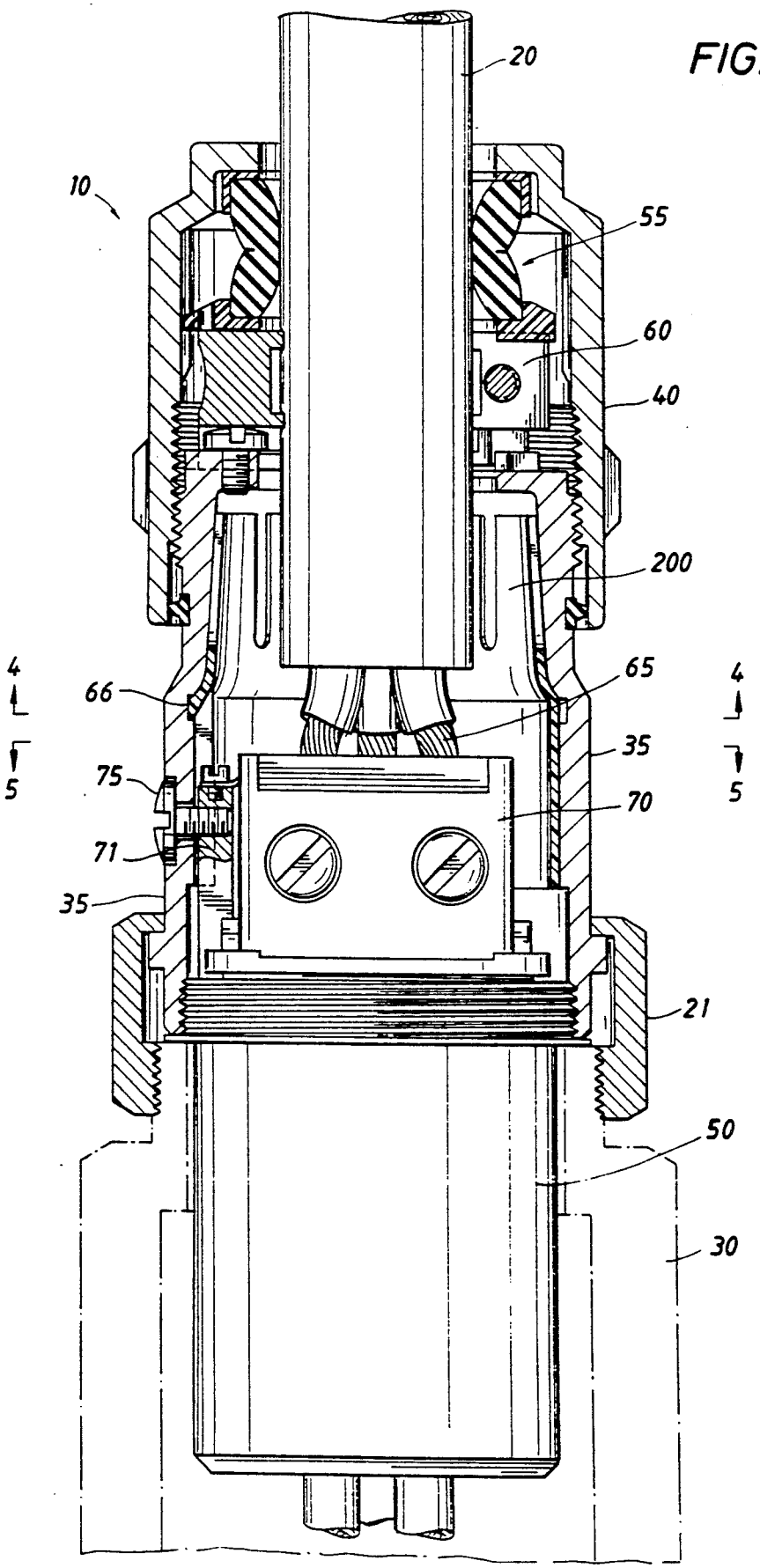
FIG. 2 is a section view showing the electrical plug and a mating receptacle.

The present invention can best be understood by reference to the Figures. FIG. 1 is a perspective view of an electrical plug assembly 10 in which the insulating liner of the present invention is used. FIG. 2 is a side view, partially in section of the electrical plug 10 and depicts the insulating liner 200. An electrical cord 20 extends from one end of the plug 10 and typically runs to a portable, electrically powered machine like a welder (not shown). At its opposite end, the plug 10 mates with an electrical receptacle 30 which provides electrical energy (shown with dotted lines) and is held at the receptacle with locking nut 21. The plug 10 consists of three exposed parts: a body 35; a cover 40; and a sleeve 50.

After entering through the cover 40, the cord 20 extends through a sealing assembly 55 where the cord 20 is environmentally sealed to prevent the introduction of water, dirt, fumes or other foreign materials into the plug 10. The cord 20 then extends through a cord gripping assembly 60 where it is held securely to prevent the cord 20 from separating from the plug 10. As the cord 20 passes into body 35 it passes through the insulating liner 200. Thereafter, conductors 65 terminate into a contact assembly 70 where they are mechanically and electrically connected to corresponding prongs by contact screws (not shown). The electrical prongs are housed in sleeve 50 which is threaded onto the plug body 35 and held in place by ground screw 75.

Figure 3:
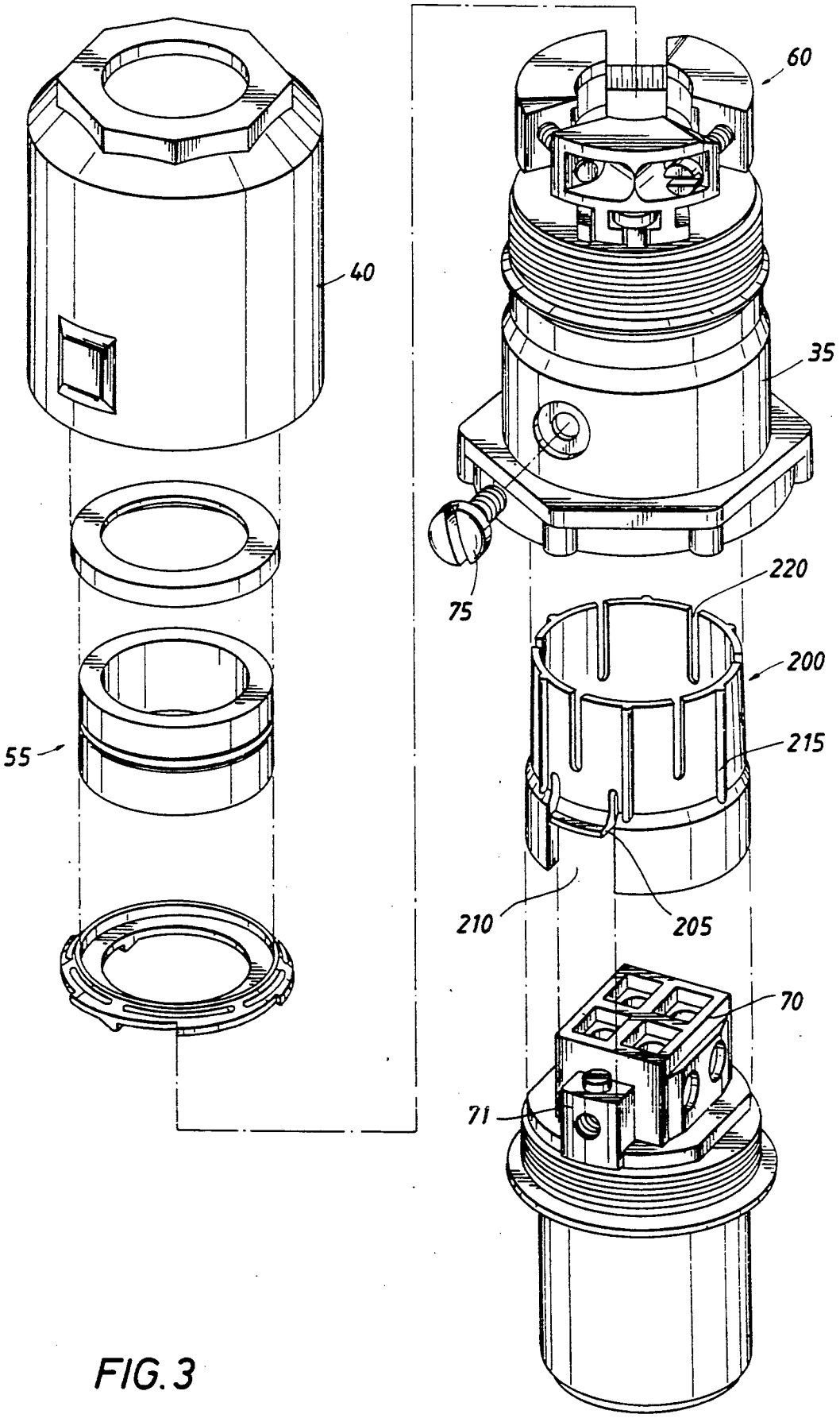
FIG. 3 is an exploded view showing the electrical plug.

As depicted in FIG. 3, the liner 200 is cylindrically shaped and includes several longitudinal slots 220 and ridges 215 which give it flexibility and rigidity and allow its insertion into body 35. In its preferred embodiment, the liner is constructed of a flame and chemical resistant nonconducting plastic. The liner 200 is retained in body 35 by a groove 66 (shown in FIG. 2) which runs around the inside of body 35. The groove 66 acts with tabs 205 located on the sides of liner 200 which extend into the groove 66 to hold the liner inside of the body 35. The relation between the tabs 205 and the groove 66 is depicted in FIG. 4. As FIG. 2 demonstrates, the groove 66 holds liner 200 in a position where liner 200 will cover prong assembly 70 when the plug assembly is assembled around an electrical cord. Once the liner 200 is inserted into the body 35, it will remain in place regardless of disassembly of the plug, ensuring that the liner 200 will always be in place during the life of the plug 10.

Another feature of liner 200 which can be appreciated in FIG. 3, are rectangular cut-outs 210 located below tabs 205. The cut outs allow the liner to extend onto the sleeve 50, covering prong assembly 70 but leaving grounding post 71 exposed. Grounding post 71 must remain exposed to allow electrical contact between the grounding post 71 and the plug body 35 and properly ground all parts of the plug 10. As depicted in FIG. 2, the grounding post is electrically connected to the body 35 by grounding screw 75 which extends through body 35 and is threaded into grounding post 71. FIG. 3 and FIG. 5 depict the relation between ground post 71, cut-out 210 of liner 200 and ground screw 75. During assembly, the plug body 35, With liner 200 in its interior is lowered onto plug sleeve 50 in an orientation which allows the cut-out 210 to fit directly over ground post 71. As the sleeve is threaded onto body 35, the liner 200 rotates with the sleeve 50, allowing cut-out 210 to remain directly over ground post 71.

In use, the plug 10 of the present invention is attached to an electrical cord 20 by first preparing the cord 20 by stripping away the covering and exposing the individual conductors of the cord 20. The sleeve 50 and the cover 40 are then un-threaded from the plug body 35. Next, the prepared cord is inserted through the cover 40, the seal assembly 55, the plug body 35 housing the insulating liner 200 and the conductors 65 are terminated into the prongs of the plug 10. The body 35 is then threaded onto the sleeve 50 and the adjustable gripping means 60 is tightened around the cord 20. Finally, the cover 40 is threaded back onto the body 35, compressing and energizing the cord seal 55.

When the plug assembly is assembled with an electrical cord, the liner of the present invention solves the problems associated with loose strands of conductor coming into electrical contact with the plug body. Also, the liner prevents contact screws securing the conductors from coming into contact with the plug body if the contact screws should become loose. In addition, the invention provides an insulating means that cannot be lost or misused and allows for proper grounding between the sleeve and the plug body.

While the insulating liner of the present invention has been described by reference to its preferred embodiment, it will be understood that other various embodiments of the device and method of the present invention may be possible by reference to the specification and the appended claims. For example, the liner could be used without slots and ridges and the cut-outs could be of any shape so long as the grounding posts are covered leaving the grounding surface open. Such additional embodiments shall be included within the scope of the appended claims.

We claim:

1. In an electrical plug assembly having a plug body, a cover attached to the first end of said plug body, a plug sleeve attached to the second end of said plug body and means for termination of electrical conductors into prongs, an insulating liner, said insulating liner comprising:

a substantially cylindrical body having a first and second ends and means for retention in said plug body whereby said liner is held in said body while rotating freely within said body;

whereby said liner prevents electrical contact between said conductors and said plug body.

2. The insulating liner as described in claim 1, wherein said means for retention includes a groove formed around the interior of said body and a plurality of outwardly facing tabs formed on said liner, said tabs extending past the outside diameter of said liner body;

whereby as said liner is inserted into said plug body, said tabs extend into said groove, retaining said liner at a given position in said body and preventing axial movement of said liner in said body.

3. The insulating liner as described in claim 2, whereby said groove and said tabs are constructed and arranged to allow said liner to rotate freely while being retained in said plug body.

4. The insulating liner as described in claim 3, whereby said plug sleeve is threadedly attached to said body.

5. The insulating liner as described in claim 4, further including a plurality of rectangular cut-outs in said second end of said liner, said cut-outs constructed and arranged to allow said liner to fit over a grounding post on said plug sleeve and allow electrical connection between said grounding post and said plug body.

6. The insulating liner as described in claim 5, whereby as said plug body is threaded to said plug sleeve, said insulating liner will remain stationary over said grounding post, preventing interference of said liner with said grounding post and said plug body.

7. A plug assembly for connection to an electrical cord, said plug assembly comprising:

a hollow body, said hollow body having first and second ends and constructed and arranged to house the electrical cord;

means for terminating the electrical cord by connection to a plurality of prongs, said prongs being located on said first end of said hollow body, said means for terminating the electrical cord being enclosed entirely within said hollow body;

a hollow cover, said hollow cover constructed and arranged to enclose said second end of said hollow body, said hollow cover constructed and arranged to allow the electrical cord to pass therethrough;

an insulating liner, said insulating liner including:

a substantially cylindrical body having a first and second ends and means for retention in said plug body whereby said liner is held in said body while rotating freely within said body;

whereby said liner prevents electrical contact between said conductors and said plug body.

* * * * *